United States Patent [19]

Bui et al.

[11] Patent Number: 4,563,544

[45] Date of Patent: Jan. 7, 1986

[54] ELECTRICAL INSULATOR OFFERING REDUCED SENSITIVITY TO POLLUTION

[75] Inventors: Ai Bui, Toulouse; Laurent Pargamin, Vichy, both of France

[73] Assignee: Ceraver, S.A., Paris, France

[21] Appl. No.: 602,676

[22] Filed: Apr. 23, 1984

[30] Foreign Application Priority Data

Apr. 29, 1983 [FR] France ..... 83 07100

[51] Int. Cl.[4] ..... H01B 17/42; H01B 17/50

[52] U.S. Cl. ..... 174/140 C; 65/60.53; 174/211; 252/519; 427/126.2; 427/126.3; 427/376.2

[58] Field of Search ..... 174/137 A, 140 R, 140 C, 174/140 S, 141 C, 209, 210, 211; 65/60.53; 252/519; 427/126.2, 126.3, 376.2; 428/697

[56] References Cited

U.S. PATENT DOCUMENTS 3,627,905 12/1971 Astle-Fletcher et al. ..... 174/140 C 3,795,499 3/1974 Ogawa et al. ..... 65/60.53

4,174,303 11/1979 Gaiffi et al. ..... 252/519 X

FOREIGN PATENT DOCUMENTS 2361204 6/1975 Fed. Rep. of Germany ... 174/140 S 586064 3/1947 United Kingdom ..... 174/140 C

*Primary Examiner*—Laramie E. Askin

*Attorney, Agent, or Firm*—Kenyon & Kenyon

[57] ABSTRACT

An electrical insulator offering reduced sensitivity to pollution comprises a body of a glass or porcelain dielectric material with a semiconductor outside coating. This coating mainly consists of zinc oxide with at least one further metal oxide added to it to make its voltage-current characteristic non-linear, such that $I=kV^{\alpha}$ where I is current, V is voltage, k and $\alpha$ are coefficients, and the value of $\alpha$ is between 20 and 50. The coating is between 0.05 and 0.5 mm thick. The further metal oxide is advantageously selected from bismuth, manganese, cobalt, chromium and antimony oxides.

6 Claims, 2 Drawing Figures

ELECTRICAL INSULATOR OFFERING REDUCED SENSITIVITY TO POLLUTION

BACKGROUND OF THE INVENTION

1. Field of the Invention

The invention concerns electrical insulators and more particularly those of which the dielectric materials are glass or porcelain.

2. Description of the Prior Art

It is known that atmospheric pollution may lead to the formation of conductive deposits on the surface of insulators.

As the electrical resistance at the level of the surface layer of the insulator is not uniform, there is observed in moist conditions the presence of dry areas in series with moist areas.

There may then be produced in these dry areas voltage gradients which are very much higher than in the moist areas, likely to reach the threshold for breakdown in air.

Moreover, when the extent of the dry areas reaches a certain proportion of the length of the insulator, there then occurs complete flashover of the latter resulting in a short-circuit across the network which takes it out of service.

In order to overcome these disadvantages it has already been proposed, in U.S. Pat. No. 3 795 499 for porcelain insulators and in British Pat. No. 1 240 854 for synthetic plastic insulators, to coat the surface of the dielectric material with a semiconductor layer with a resistivity which does not vary with the current, such as a semiconductor enamel, for example, so as to juxtapose to the polluted layer of irregular resistivity an underlying layer of constant resistivity in order to control the distribution of potential along the insulator.

This solution is not fully satisfactory, however.

If the current passing through the semiconductor layer is not significantly higher than that passing through the polluted layer, the semiconductor layer has virtually no effect, since it is the polluted layer which determines the distribution of potential, in an irregular manner.

On the other hand, if the current in the semiconductor layer is significantly higher than that in the polluted layer, the phenomena resulting from the juxtaposition of the dry areas and the moist areas cannot occur, but the energy losses are then too high for this solution to be economically acceptable. Moreover, this solution is not durably reliable.

It is therefore necessary to adopt a compromise solution, which is satisfactory only for cases of slight pollution.

Also, with a semiconductor coating of defined resistivity it is only possible, in cases of serious pollution, to attenuate the defects explained hereinabove and not to eliminate them.

The present invention makes it possible to remedy these disadvantages.

SUMMARY OF THE INVENTION

The object of the present invention is an electrical insulator offering reduced sensitivity to pollution comprising a body of a glass or porcelain dielectric material having an external semiconductor coating, wherein said coating consists of a ceramic essentially comprising zinc oxide to which is added at least one metal oxide adapted to create non-linearity in the voltage-current characteristic of said zinc oxide, such that $I=kV^{\alpha}$ where I is current, V is voltage, k and $\alpha$ are coefficients, and the value of $\alpha$ is between 20 and 50, the thickness of said coating being between 0.05 and 0.5 mm.

By way of example, in the coating in accordance with the invention, a variation in the current density of the order of $10^6$ corresponds to a variation in the voltage gradient of approximately 2. The coefficients k and $\alpha$ are characteristic of the material and the geometric dimensions (notably the leakage path of the insulator and the thickness of the coating).

The coating advantageously contains more than 90% zinc oxide.

The metal oxide is advantageously selected from the group comprising bismuth, manganese, cobalt, chromium and antimony oxides.

The special characteristic of the zinc oxide based coating employed within the context of the present invention is that it prevents local formation of arcs in the dry areas. The distibution of the electric field at the surface of the insulator is improved and the flashover arc thus prevented.

Thus in cases of serious pollution, given the electrical characteristics of the zinc oxide based layer, when the current increases very sharply in the zinc oxide layer, the voltage may be stabilized below the threshold for flashover in air.

As soon as the problems resulting from pollution are reduced, the current returns to a very low value which does not generate any significant energy loss.

This functioning applies in the case of slight pollution, resulting then in a very low current in the polluted areas; the current in the zinc oxide based surface layer is very low, producing no significant energy loss.

Other objects and advantages will appear from the following description of an example of the invention, when considered in connection with the accompanying drawing, and the novel features will be particularly pointed out in the appended claims.

DESCRIPTION OF THE PREFERRED EMBODIMENT

Figure 1:
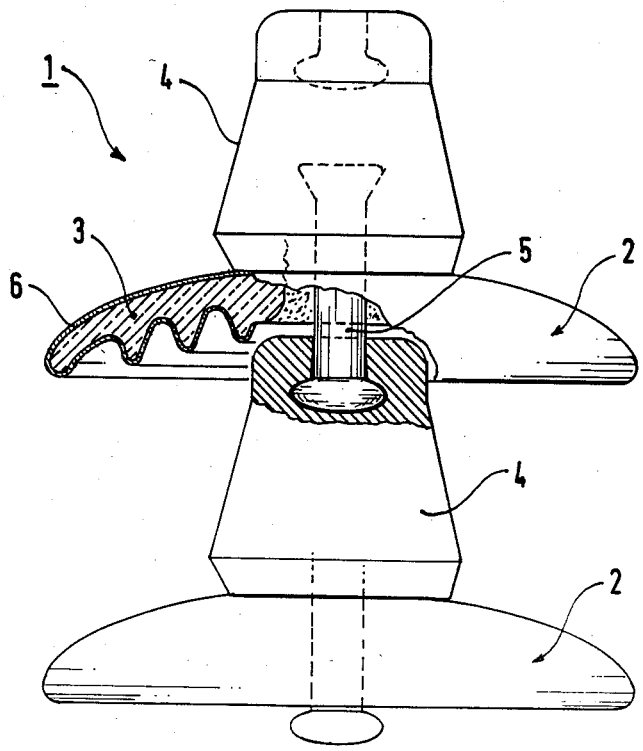
FIG. 1 is a schematic representation in partial cross-section of part of an insulator in accordance with the invention.

FIG. 1 shows a section 1 of an insulator consisting of an assembly of insulative elements 2. Each element 2 substantially comprises a dielectric material 3 (glass or porcelain, for example) equipped with a metal cap 4 and a metal coupling pin 5.

The dielectric material 3 is externally coated with a thin layer 6 based on zinc oxide doped with at least one other metal oxide.

The layer 6 is between 0.05 and 0.5 mm thick.

There follow three examples of the composition of a coating layer:

Per 10 grams of coating material:

| First example | | |
|---|---|---|
| ZnO | 9.6682 g | 99 mole % |
| $Bi_2O_3$ | 0.2796 g | 0.5 mole % |

-continued

| | | |
|---|---|---|
| $MnO_2$ | 0.0522 g | 0.5 mole % |
| Second example | | |
| ZnO | 9.1171 g | 97.0 mole % |
| $Bi_2O_3$ | 0.2691 g | 0.5 mole % |
| $MnO_2$ | 0.0502 g | 0.5 mole % |
| $Co_3O_4$ | 0.1391 g | 0.5 mole % |
| $Cr_2O_3$ | 0.0878 g | 0.5 mole % |
| $Sb_2O_3$ | 0.3367 g | 1 mole % |
| Third example | | |
| ZnO | 9.1171 g | 97.0 mole % |
| $Bi_2O_3$ | 0.2691 g | 0.5 mole % |
| $MnO_2$ | 0.0502 g | 0.5 mole % |
| $Co_3O_4$ | 0.1391 g | 0.5 mole % |
| $Cr_2O_3$ | 0.0878 g | 0.5 mole % |
| $Sb_2O_3$ | 0.3367 g | 1 mole % |

The mixture of the third example is sintered at 1,250° C. before adding the 0.5 moles of $Bi_2O_3$ (0.2691 g of $Bi_2O_3$) per 10 grams of product.

The composition and the thickness of the coating layer are adjusted according to the electrical characteristics required of said layer.

The shape of the insulator is also taken into account.

The coating based on zinc oxide may be applied using various methods.

Thus, with an insulator comprising a procelain dielectric material, the first stage is to manufacture said dielectric material.

The material to constitute the coating is prepared as follows:

The powdered mixture of zinc oxide and the additional metal oxides is homogenized and ground and then subject to preliminary sintering in ambient air at approximately 700° C. for two hours; the roasted mixture is reground. An organic binder is then preferably incorporated into it; the combination is dried by conventional means and the mixture obtained is reground: the particle size is then of the order of 1 micron.

The powder is then deposited as a layer on the outside surface of the dielectric material, by compression, silkscreening, spraying or vacuum deposition, for example. The thickness of the layer is determined so as to be compatible with the temperature rises to which it will be subjected during operation of the insulator and according to the required electrical characteristics.

For a glass insulator, the layer based on zinc oxide may be deposited by, in particular, the vacuum deposition and spray deposition methods.

Figure 2:
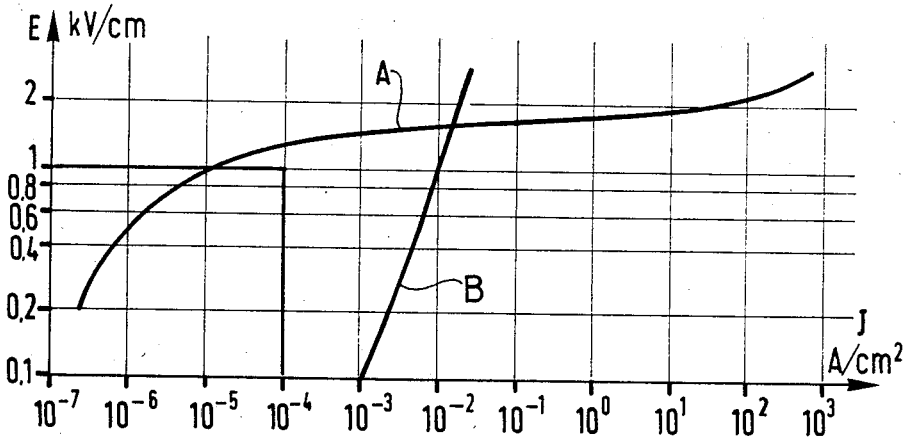
FIG. 2 represents the electrical characteristics of the doped zinc oxide used in the composition of the coating in accordance with the invention and a semiconductor enamel employed in the prior art for coating insulators.

In FIG. 2, the voltage gradient E in kV/cm is plotted along the ordinates, and the logarithm of the current density J in amperes/cm$^2$ is plotted along the abscissae.

The measurements were taken at 25° C. The curve (A) relates to a material having the composition of the first example hereinabove and the curve (B) relates to a semiconductor enamel used in the prior art for coating an insulator.

As is clearly shown on the curve (A), when the current density varies from $10^{-4}$ to $10^{+2}$, that is to say in a ratio of $10^6$, the voltage does not even vary in a ratio of 2, whereas in the case of the semiconductor enamel (curve B), when the current varies in the ratio 10 the voltage also varies in the same ratio 10.

For the zinc oxide to which metal oxides are added, the curve (A) corresponds to the equation: $I=kV^{\alpha}$, where the value of $\alpha$ is between 20 and 50.

Although such electrical properties have already been utilized in the field of lightning arresters, it should be emphasized that this utilization differs totally from that desribed in this application and that the results observed in the case of lightning arresters cannot be transposed to the insulators with which the present application is concerned.

In lightning arresters the current which passes through the zinc oxide is very high, exceeding 1,000 amperes and possibly attaining 30,000 amperes, whereas in the insulator in accordance with the invention the current is between 1 milliampere and 1 ampere.

It follows in particular that the cross-section of the doped zinc oxide through which the current passes in a lightning arrester is much greater than the cross-section of the coating of the insulator in accordance with the invention.

In the case of the insulator in accordance with the invention, the action of the zinc oxide based layer is localized and manifests itself at a number of locations for relatively short time periods without resulting in any interruption of service.

On the other hand, the action is instantaneous in lightning arresters; it affects the entire lightning arrester, through all of which the current flows, and results in service being interrupted by the tripping out of circuit-breakers protecting the line.

It will be understood that various changes in the details, materials and arrangements of parts, which have been herein described and illustrated in order to explain the nature of the invention, may be made by those skilled in the art within the principle and scope of the invention as expressed in the appended claims.

For example, it may be applied to support type and other type insulators.

We claim:

1. Electrical insulator offering reduced sensitivity to pollution comprising a body of a glass or porcelain dielectric material having an external semiconductor coating, wherein said coating consists of a ceramic essentially comprising zinc oxide to which is added at least one metal oxide adapted to create non-linearity in the voltage-current characteristic of said zinc oxide, such that $I=kV^{\alpha}$ where I is current, V is voltage, k and $\alpha$ are coefficients, and the value of $\alpha$ is between 20 and 50, the thickness of said coating being between 0.05 and 0.5 mm.

2. Insulator according to claim 1, wherein said coating contains more than 90% zinc oxide.

3. Insulator according to claim 1, wherein said metal oxide is selected from the group consisting of bismuth, manganese, cobalt, chromium and antimony oxides.

4. Insulator according to claim 3, wherein said coating contains more than 90% zinc oxide.

5. Insulator according to claim 1, wherein said metal oxide is bismuth oxide.

6. Insulator according to claim 4, wherein said coating contains more than 90% zinc oxide.

* * * * *